US005539945A

United States Patent [19]

Rosenberg et al.

[11] Patent Number: 5,539,945

[45] Date of Patent: Jul. 30, 1996

[54] EMERGENCY STRETCHER AND EVACUATION SYSTEM

[76] Inventors: Norman Rosenberg; Marlene A. Rosenberg, both of 11122 Alford, Brighton, Mich. 48116

[21] Appl. No.: 435,392

[22] Filed: May 5, 1995

[51] Int. Cl.[6] ..... A61G 7/10; A61G 1/00

[52] U.S. Cl. ..... 5/626; 5/81.1 T; 5/627; 182/237; 242/371

[58] Field of Search ..... 5/626, 627, 628, 5/625, 81.1, 83.1; 242/371; 182/237, 236

[56] References Cited

U.S. PATENT DOCUMENTS

| | | | |
|---|---|---|---|
| 616,282 | 12/1898 | Allen . | |
| 3,052,426 | 9/1962 | Avis | 182/237 |
| 3,701,395 | 10/1972 | Theobald | 182/3 |
| 4,688,279 | 8/1987 | Vance | 5/82 |
| 5,077,844 | 1/1992 | Twitchell et al. | 5/87 |
| 5,179,746 | 1/1993 | Rogers | 5/625 |
| 5,193,233 | 3/1993 | Miller | 5/81.1 |
| 5,249,321 | 10/1993 | Graf | 5/626 |
| 5,343,981 | 9/1994 | Schroemges et al. | 182/236 |
| 5,375,277 | 12/1994 | Carr et al. | 5/626 |

OTHER PUBLICATIONS

[No Author Listed], "Nursing Home Fire Results in 12 Deaths", *Fire Journal,* Jul./Aug. 1990, pp. 34–37.

*Primary Examiner*—Alexander Crosz

*Attorney, Agent, or Firm*—Gifford, Krass, Groh, Sprinkle, Patmore, Anderson & Citkowski

[57] ABSTRACT

A system for transporting a person on a stretcher between upper and lower platforms connected by a stairway includes a retractable cable source located at the upper level whereby with one end of stretcher attached to the cable, an assistant to grasp the other end of the stretcher and transport the individual up or down the stairway with the cable providing tension to stabilize movement. Multiple stretchers may be located at either or both levels, in which case the retractable cable source provides sufficient tension to assist in pulling the stretcher up the stairway. In the preferred embodiment the retractable cable source includes a housing into which the cable retracts and a loaded spring disposed within the housing. Also in the preferred embodiment, the stretcher is sufficiently flexible to permit turning of the stretcher during transport. The invention is particularly suited to buildings having multiple levels and a larger number of nonambulatory individuals, as might be found in hospitals, convalescent centers, and so forth. In an embodiment adapted for installation in a stairwell having multiple levels, the system preferably includes one or more stretchers and cable supply devices accessible at multiple stairwell levels.

12 Claims, 3 Drawing Sheets

EMERGENCY STRETCHER AND EVACUATION SYSTEM

FIELD OF THE INVENTION

The present invention relates generally to rescue apparatus, and, in particular, to an emergency stretcher and related equipment forming part of a stairwell evacuation system.

BACKGROUND OF THE INVENTION

It is highly unfortunate that evacuation of facilities intended for patient care can often lead to the most disastrous consequences. For example, in the July/August 1990 issue of *Fire Journal,* on page 34, there is story describing a 1989 fire at the Hillhaven Rehabilitation and Convalescent Center in Norfolk, Va. which killed 12 patients and injured or forced the relocation of almost 100 others. The nursing home in which the fire occurred was a four-story, fire-resistive building constructed in the late 1960s. There were 161 patients in the facility at the time, and most of them were elderly and nonambulatory. According to one of the firefighters on the scene, problems with evacuation were exacerbated by the fact that residents had to be carried down stairwells on blankets and in regular chairs. Many of the patients were also hooked up to various medical equipment, which further hampered the evacuation effort. Indeed, 9 of the 12 patients who died, age 65 to 97, resided on the second floor of the building. There are numerous other reports of such unfortunate incidents, including a recent fire at the Petersburg Hotel in Petersburg, Va. which broke out on New Year's Eve on the fourth floor. About 25 people were evacuated from the fourth floor and from the two floors above, but four people lost their lives as a result of the fire.

What is needed is an efficient mechanism for evacuating individuals from these and other facilities, but an ideal implementation presents numerous conflicting requirements. On the one hand, the arrangement must be sturdy and reliable, but since it may rarely, hopefully never, be called upon for use, great expense is unwarranted. Additionally, the solution must be sophisticated enough to maximize the comfort of an individual being transported, including patients with IVs and other medical devices and instrumentation. However, the end product and method of use must not be so sophisticated that a non-skilled operator would not readily realize what to do, especially during an emergency situation.

Solutions to this problem range from harnesses and hoists, only some of which are suitable to the nonambulatory patient, to emergency stretcher systems and stair chairs, which tend to be complex and difficult for the uninitiated to operate. U.S. Pat. Nos. 616,282; 3,701,395; 4,688,279; 5,077,844 and 5,193,233 provide an introduction to some of the solutions disclosed.

U.S. Pat. No. 5,179,746 to Rogers teaches an emergency stretcher having particular utility in stairwell situations. Essentially, this apparatus resembles a hand truck in the form of a rigid frame including an articulated handle at its proximal end, and a set of wheels at its distal end. The frame further includes a pair of rails on its underside, whereby, when a staircase is reached, the frame may be articulated to be parallel to the incline defined by the staircase, with the rails then being used to glide on the edges of the stairs, thereby avoiding the bumpy ride inherent with the use of wheels.

While the device of Rogers should provide a relatively smooth transport, the approach presents certain disadvantages. For one, the stretcher is relatively complex and apparently expensive, precluding the use of numerous such stretchers supplied in stairwells only to remain idle for long periods of time. Additionally, the apparatus is somewhat sophisticated in the sense that its intended operation may not be obvious to someone exposed to the device for the first time. Finally, and perhaps most importantly, since the stretcher is held from above with respect to a staircase, it may be impossible for a lighter-weight or weaker individual to guide someone down the stairs, risking an uncontrolled, runaway situation, potentially causing greater harm to the individual being transported. Overlooked by the prior art, then, is an efficient and relatively simple evacuation system, particularly for use in stairwells, based upon a stretcher design which is efficient yet inexpensively produced, and a way to use the stretcher by anyone, regardless of physical ability.

SUMMARY OF THE INVENTION

The present invention is directed toward a system for transporting a person on a stretcher between levels in a stairwell. Broadly, a retractable cable source is disposed at the upper level, and one end of stretcher is attached to the cable, enabling an assistant to grasp the other end of the stretcher and transport the individual down the stairway with the cable providing tension to stabilize movement. Multiple stretchers are preferably located at multiple levels within the stairwell. In an alternative embodiment the invention may be used for upward transport, the retractable cable source provides sufficient tension to assist in pulling the stretcher up the stairway. In the preferred embodiment the retractable cable source includes a housing into which the cable retracts and a loaded spring disposed within the housing. Also in the preferred embodiment, the stretcher is sufficiently flexible to permit turning of the stretcher during transport preferably at side-to-side angles ranging from 45° to 90°.

The invention is applicable to various structures, though it is expected to be particularly valuable in facilities having multiple levels and a larger number of nonambulatory individuals as might be found in hospitals, convalescent centers, and so forth. In an embodiment adapted for installation in a stairwell having multiple levels, the system preferably includes one or more stretchers accessible at multiple stairwell levels, each stretcher having a forward end, a rear end and an upper surface upon which to bind a nonambulatory individual, the forward end of each stretcher including one or more handles enabling an assistant to guide the stretcher while moving it between levels, the rear end of each stretcher including a cable attachment point. At least one cable supply device is located at one or more of the stairwell levels, each cable supply device including a graspable free end adapted to be removably secured to the cable attachment point on a stretcher, and a second end bound within the cable supply device, whereby the stretcher having the nonambulatory individual bound thereon and the cable attached thereto, may be moved from one stairwell level to another, with the cable helping to ensure that the stretcher will not descend in an uncontrollable manner.

DETAILED DESCRIPTION OF THE PREFERRED EMBODIMENTS

The present invention improves upon the prior art by providing an evacuation system based upon lightweight and relatively inexpensive stretchers, which are used in conjunction with one or more tensioned drag lines, each having a first end secured to a point in the stairwell, and a second end releasably attachable to a stretcher, the tension on the line helping to stabilize transport of the nonambulatory individual. In one embodiment the tension of the line is sufficient to balance a majority of the weight associated with the stretcher and individual carried thereon, enabling even a physically inept individual to guide the stretcher up as well as down a stairwell. In the preferred embodiment, the tensioned lines are retractably supplied through a spring-loaded housing, preferably situated at each landing associated with the stairwell. One or more of the stretchers are also preferably provided at each landing level, preferably on the order of four to eight per floor.

In operation, during an emergency evacuation situation, one of the stretchers is acquired from a hanger, and the nonambulatory individual is strapped thereto using means provided for that purpose. Space permitting, the stretcher may be unfolded on the landing itself and the individual or patient strapped thereto in a lying position, though other approaches are readily accommodated. For example, in addition to the more common supine placement of the individual, a lateral placement may instead be accommodated depending upon the circumstances, which would also allow a greater turning of the stretcher, depending upon the construction used. It is anticipated that, utilizing the stretcher described with reference to FIG. 2A, that a supine positioning might facilitate the turning of 45°, whereas a lateral positioning, if possible, might facilitate a turning of 90° or even greater, with the amount of bending being limited only by exact positioning of the individual, the condition of the person, and other practical factors.

Once strapped to the stretcher frame, the individual assisting in transport grabs the free end of the nearest retractable line, and attaches it to the end of the stretcher oriented "uphill" during transport. The assistant then grasps one or more handles provided on the "downhill" side of the stretcher, and pulls the person on the stretcher down (or up) to the next landing, with the tension on the line ensuring against an uncontrolled descent. Regardless of the direction of travel, once a new landing is reached, the line is disconnected, where it retracts back into its housing at the previous level for subsequent use, and a new line at the next level is attached, and movement is repeated on a landing-by-landing basis, until the nonambulatory individual is safely removed from the dangerous situation.

Figure 1:
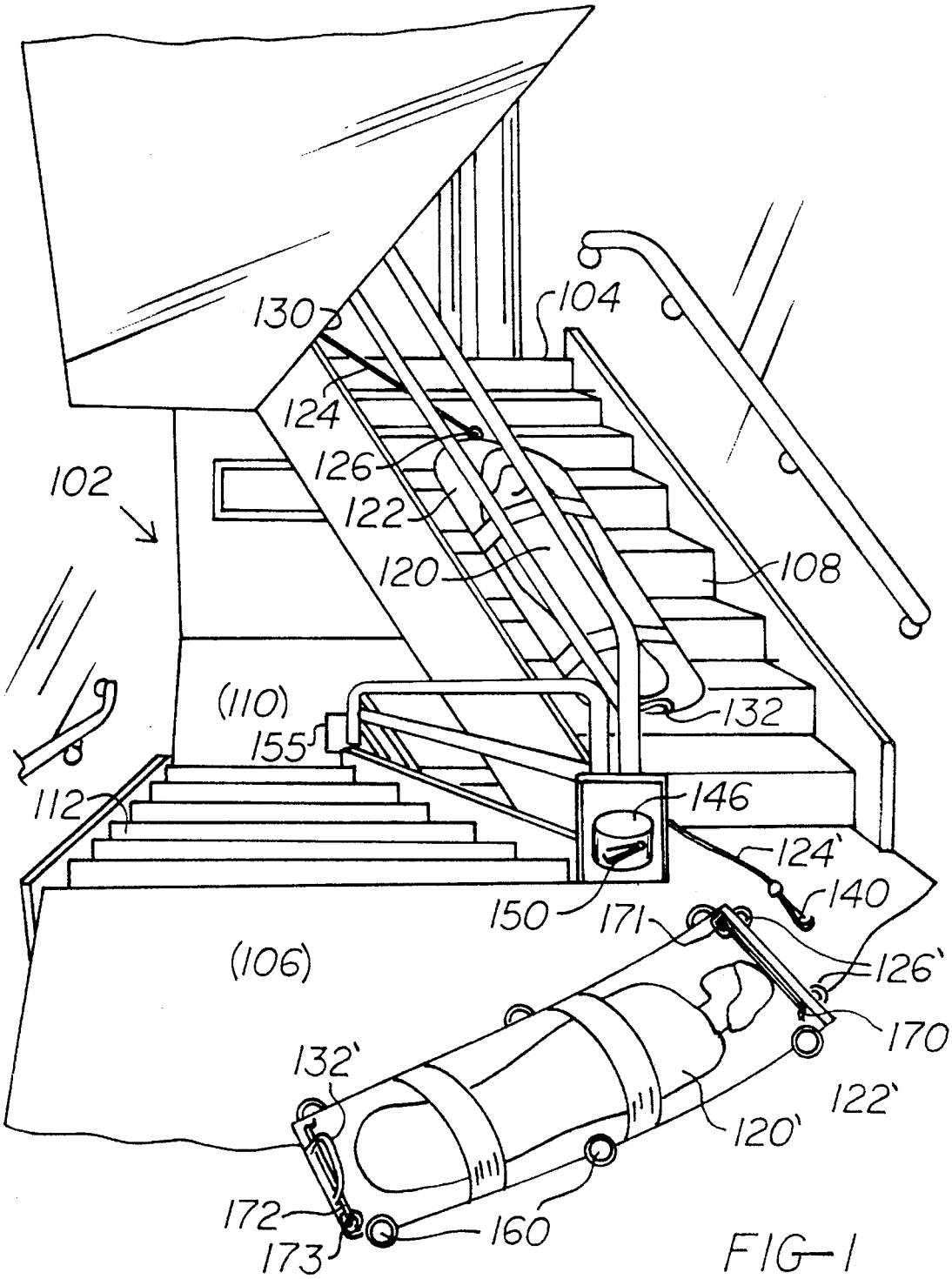
FIG. 1 is an oblique perspective view of a stairwell environment applicable to the present invention.

Now making reference to the figures, FIG. 1 is a drawing of a stairwell environment depicted generally at 102, which might be seen by an individual standing on landing 106 representative of one of the stairway levels. Also shown is an upper level 104 which connects to the intermediate level 106 through stairs 108, and a lower level 110 which connects to the level at 106 through a stairway 112. Such a switchback type of stairway arrangement is quite common in modern buildings, and accordingly will be used to illustrate how the present invention may be implemented, with the understanding that the system is likewise readily applicable to any stairway configuration, regardless of the number of levels.

FIG. 1 shows a first individual 120 on a first stretcher 122 being transported down from level 104 to level 106 by means of a cable 124 attached at point 126 on the stretcher 122, the cable being released from a retractable cable device 130 which is hidden from view in FIG. 1. At the lower end of the stretcher 122 there are one or more handles 132 which an assistant (not shown) would use to pull to the individual 120 on stretcher 122 down from level 104 to level 106 or, given a sufficiently strong pulling power behind cable 124, move the individual 120 on stretcher 122 up from level 106 to level 104 in the event that a fire or other dangerous situation is below level 106. For upward movement the assistant would necessarily first need to ascend the stairs and grab the free end of the cable associated with the next highest level and pull it down to the level below.

The strength of the tension on the drag line may be varied in accordance with circumstances according to the invention. If it is known that a particular cable might be used for both upward and downward transport, the tension on the cable will be preferably adjusted so that it is strong enough to assist in pulling an individual on a stretcher up the stairway, but not so strong that it would need an assistant's ability to guide an individual down the stairway. In either case, the tension would be at least strong enough to retract the cable back into the housing for a subsequent usage. In an alternative embodiment, separate retractable cable mechanisms may be employed at one or more levels, with one being labeled "UP" and having a very strong pulling power for assisting an individual up a stairway, and a second housing labeled "DOWN" with only enough power to retract the cable back into the housing, thereby offering the least amount of resistance when guiding an individual down a stairway.

Continuing the reference to FIG. 1, when the individual 120 is safely placed on level 106, the individual now being depicted at 120' on stretcher 122', the cable (now 124'), may be detached from one or more connection points 126' using a removably securable type of fastener 140, enabling the cable 124' to be withdrawn up the stairs 108 and into the retractable cable supply mechanism 130. In the preferred embodiment the handle 132 (or 132') is constructed upwardly from the plane of the stretcher, at a right angle, for example, so that it may be convenient for use yet not interfere with any sliding motion through the stairwell. Additionally, in the preferred embodiment, wheels 160 will be added on both sides of the stretcher to help facilitate rolling travel. Preferably, three sets of such wheels will be used, one pair on each end, and a third positioned midway along the length of the stretcher proper. Additionally, in the preferred embodiment, collapsible IV holder units 170 and 172 are provided, these being pivotably attached to the stretcher base at points 171 and 173, respectively. Preferably, at these pivotal attachment points, there is further included a hand-operated locking engagement mechanism, enabling an assistant to fold up one or both of the IV holders and, by turning a device such as a thumb screw, lock the holder into an erect position, thus enabling fluid sources, and so forth to be suspended therefrom in hanging fashion.

Once on level 106, a new cable contained within a different retractable cable supply mechanism 146 associated with level 106 having connector 150 may be attached at point 126', with the attendant now guiding the patient 120' down the stairs 112 to platform 110 as the cable attached to connector 150 is retractably drawn from the supply at 146. Once on level 110, connector 150 would be released, and a new cable associated with level 110 at 155 (not shown) would be attached to the stretcher, and the process would continue until the individual is safely transported out of the building and the dangerous situation present therein.

Various points should be understood with regard to FIG. 1. Firstly, although the stretcher is shown to have user-specific ends, one with an attachment point and another with handles, in alternative embodiments of the invention, the stretcher may be bi-directional in nature, having both handles and attachment points at both ends so that, in a time-critical situation, one would not have to bother with proper orientation. For that matter, the handles and attachment points may be mechanically identical, that is, an attendant might simply attach the cable to one of the handles, then use handles at the other end for guiding the stretcher and individual strapped thereto. Also, although the retractable cable mechanisms are shown centrally located between two sets of stairs, it should be understood that such cable mechanisms may be located anywhere where convenient or accessible, so long as the cable contained therein may be used for the purpose described above.

In the event that it is known a priori that patients or nonambulatory individuals will only be moved from upper levels to lower levels, the retractable cable supply need only exhibit sufficient strength to be drawn back into its respective housing, preferably using a loaded, spiral-type spring contained within the housing. If, on the other hand, the invention is used for bi-directional transport down from one level to another or up from the lower to the one above, the spring or other retraction mechanisms associated with the cable supply should then be strong enough to assist in moving the patient up from one level to another. This strength need not be sufficient to actually pull the patient on the stretcher up with no help whatsoever, but may simply provide relief power, for example, to enable an elderly person or weaker individual to transport someone from one level up to another who might weigh more than they do.

It should further be noted in FIG. 1 that certain aspects of the invention may take on various alternative embodiments while remaining within the scope and spirit of the invention. As one example, although, in the preferred embodiment, the hooks 140 and 150 are shown to have locking mechanisms, there actual design may vary from a simple hook shape with no locking mechanism to much more complex devices such as those types used in mountain climbing, and so forth. Additionally, although only a single, centrally located attachment point and opposing handle are shown on the stretchers in FIG. 1, as will be evident from FIGS. 2 and 3, other attachment and grasping arrangements are equally accommodated.

Figure 2A:
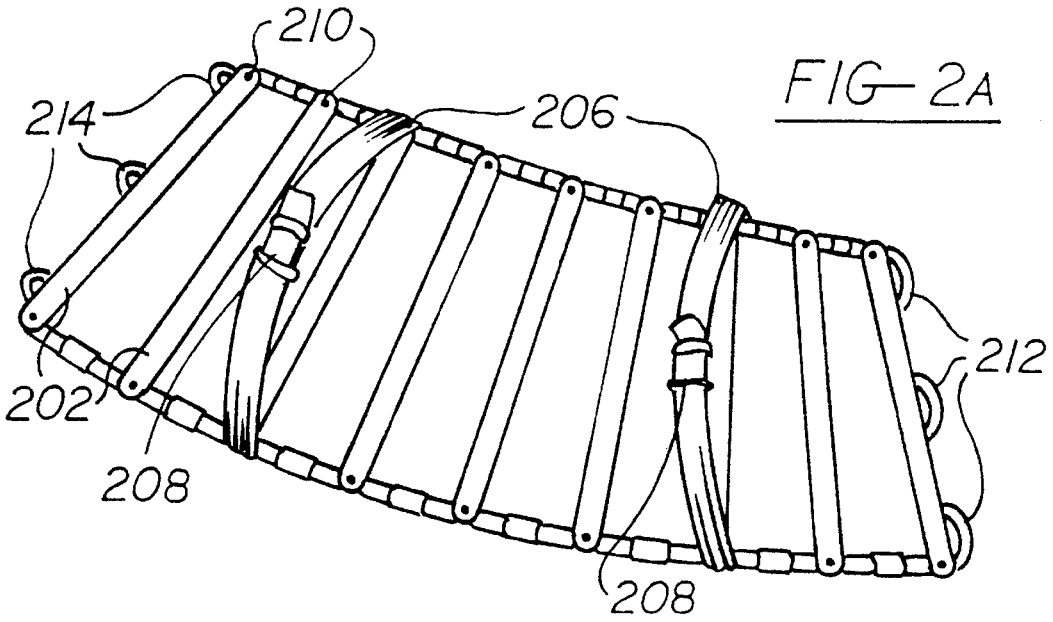
FIG. 2A is an oblique drawing of an articulated stretcher according to the invention capable of negotiating turns within a stairwell environment.
Figure 2B:
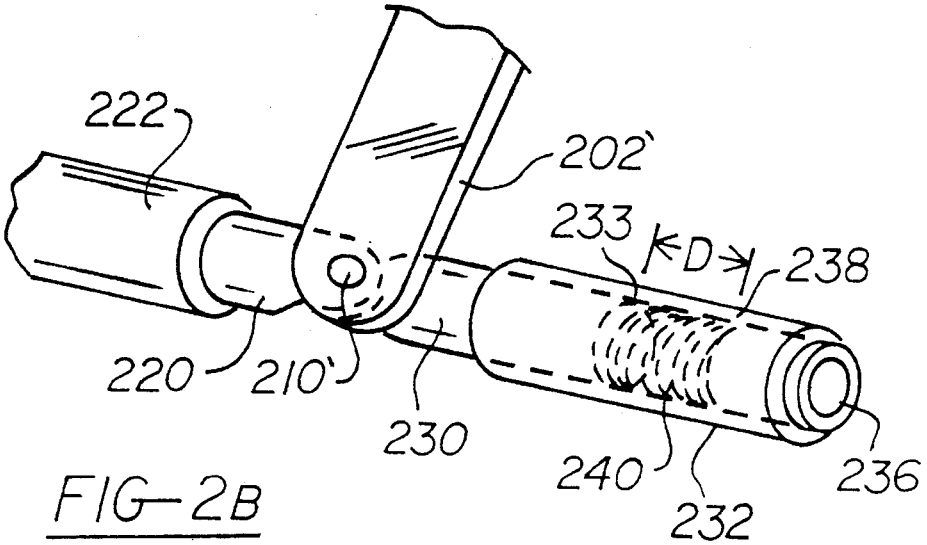
FIG. 2B is a closeup view of one of the articulating joints of the stretcher of FIG. 2A.

Now making reference to FIG. 2, there is shown in oblique form a preferred embodiment of an articulating stretcher adapted for use with the invention. FIG. 2A is a perspective overview of the stretcher, whereas FIG. 2B is a closeup view of one of the articulating joints. The stretcher shown in FIG. 2A includes a plurality of transverse members 202 with at least two such members further including binding means 206 used to bind an individual to the stretcher. The straps 206 preferably include means 208 for adjustable securing an individual to the stretcher. This means may also take on various alternative embodiments, including the conventional adjustment mechanisms 208 shown, hook-and-loop type fasteners, and various other alternatives including means utilizing elastic members.

The transverse members 202 are attached on either side at pivot points 210, which attach to telescoping units on either side, the operation of which will become more evident with respect to FIG. 2B. As mentioned above, various connection point and handle configurations are possible according to the invention, and FIG. 2A shows three handles 212 on end of the stretcher and three attachment points 214 on the other.

Now making reference to FIG. 2B, a portion of the one of the transverse members 202' is shown in the vicinity of one pivot point 210'. Pivotably attached at the point 210' are two rigid members 220, which are preferably cylindrical in nature and attach separately through 210' such that they pivot with respect to point 210' independent of each other. In this embodiment, the member 220 is slidably received by an outer sleeve 222, whereas the other element 230 is slidably received within an outer sleeve 232. Within the sleeve 232, which is representative of all other such sleeves according to this embodiment, member 230 ends at point 233, and the end of a different element 236 slidably received within the outer sleeve 232 begins at point 238, the two ends 233 and 238 being spaced apart by a distance D. The use of this spacing D enables the distance between transverse elements 202 to vary at their sides, enabling this embodiment of the stretcher to take on an arc shape, even when the stretcher is substantially contained within a single plane. A coil-type spring 240 may be included to control the telescoping-type movement.

In the preferred construction of this embodiment, the maximum distance between the transverse members 202 is preferably greater than that between outwardly facing edges of stairs in a stairwell, enabling the stretcher to remain substantially disposed within a single plane parallel to the stairs as an individual is transported thereon. All components in this embodiment with the exception of the straps 206 are constructed of a lightweight yet rigid material such as aluminum, though other metals and certain plastics may alternatively be utilized.

Figure 3:
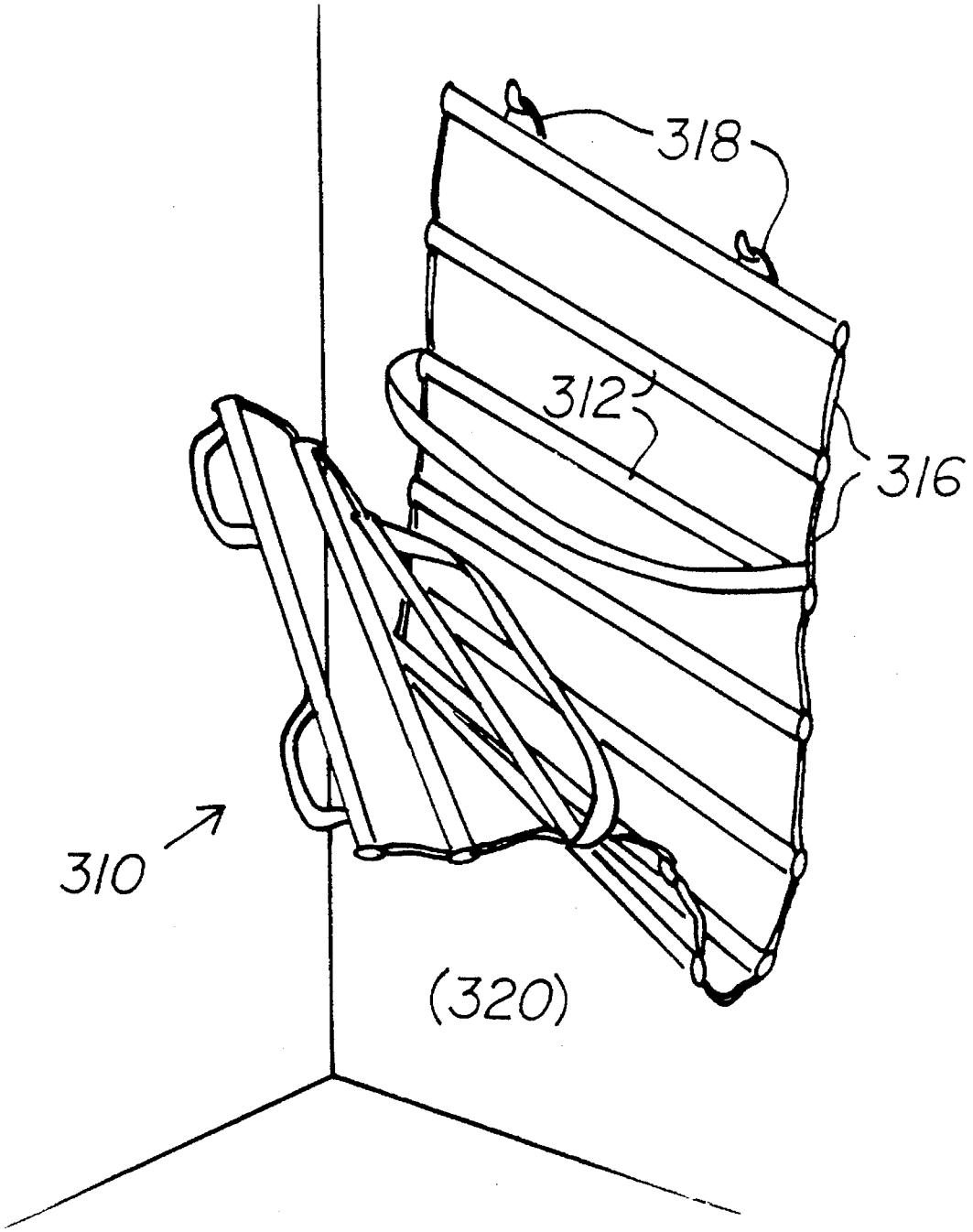
FIG. 3 is an alternative embodiment of a stretcher which twists and turns, and which may be folded and hung onto a wall until used.

FIG. 3 shows an alternative embodiment of a stretcher generally at 310 wherein the transverse members 312, also rigid, are separated from one another by flexible longitudinal pieces 316 on either side, as shown. In this embodiment, these elements 316 may be metal cable, or fiber or plastic/nylon ropes, or the like. Although the configuration depicted in FIG. 3 is inferior to that of FIG. 2 in that an individual mounted thereon may have a bumpier ride down the stairwell, this embodiment offers more economical fabrication, and also twists in two directions, enabling negotiation through stairwell situations which might be that much more confining. Additionally, owing to the fact that this configuration is foldable lengthwise, it may be conveniently hung up until use, for example through the use of hooks 318 on wall 320.

Having thus described my invention, I claim:

1. A system for transporting a person on a stretcher between an upper and a lower stairway level, the system comprising:

a retractable cable source disposed at the upper level; and a stretcher having two ends and means for attaching the cable to at least one of the ends, whereby, with the cable attached to the stretcher, an assistant may grasp the other end of the stretcher and transport an individual on the stretcher down the stairway with the cable providing tension to stabilize movement.

2. The system as set forth claim 1, wherein one or more stretchers are removably disposed at the upper level.

3. The system as set forth claim 1, wherein one or more stretchers are located at the lower level, the retractable cable source providing sufficient tension to assist in pulling the person on the stretcher up the stairway.

4. The system as set forth claim 1, wherein the stretcher is sufficiently flexible to permit turning during transport.

5. The system as set forth claim 1, wherein the stairway is in a hospital.

6. An emergency evacuation system for nonambulatory individuals adapted for installation in a stairwell having multiple levels, the system comprising:

one or more stretchers accessible at multiple stairwell levels, each stretcher having a forward end, a rear end and an upper surface upon which to bind a nonambulatory individual, the forward end of each stretcher including one or more handles enabling an assistant to guide the stretcher while moving it between levels, the rear end of each stretcher including a cable attachment point; and at least one cable supply device disposed at one or more stairwell levels, each cable supply device including a graspable free end adapted to be removably secured to the cable attachment point on a stretcher, and a second end bound within the cable supply device, whereby the stretcher having the nonambulatory individual bound thereon and the cable attached thereto, may be moved from one stairwell level to another, with the cable helping to ensure that the stretcher will not descend in an uncontrollable manner.

7. The emergency evacuation system as set forth in claim 6, wherein the cable supply device includes means for retracting the cable.

8. The emergency evacuation system as set forth in claim 7, wherein the means for retracting the cable provides sufficient cable-pulling power to aid the assistant in pulling the stretcher having the nonambulatory individual bound thereon up the stairwell from one level to another.

9. The emergency evacuation system as set forth in claim 7, the cable supply device including a housing into which the cable retracts, and the means for retracting the cable including a loaded spring disposed within the housing.

10. The emergency evacuation system as set forth in claim 6, wherein one or more of the stretchers include articulation means to assist such stretchers in negotiating turns within the stairwell.

11. The emergency evacuation system as set forth in claim 10, wherein the stretchers with articulation means have right and left sides, the lengths thereof being adjustable relative to one another.

12. The emergency evacuation system as set forth in claim 6, wherein the stairwell is within a patient-care facility.

* * * * *